United States Patent [19]

Mundhenke

[11] Patent Number: 4,961,328

[45] Date of Patent: Oct. 9, 1990

[54] LOCK BIT ARRESTING CYLINDER LOCK

[76] Inventor: Erich Mundhenke, Am Knappenberge 38, D-3252 Bad Münder 1/Hachmühlen, Fed. Rep. of Germany

[21] Appl. No.: 435,233

[22] Filed: Nov. 13, 1989

[30] Foreign Application Priority Data

Nov. 12, 1988 [DE] Fed. Rep. of Germany ..... 38481
Jun. 24, 1989 [EP] European Pat. Off. ..... 89111569.3

[51] Int. Cl.[5] ..... E05B 63/00

[52] U.S. Cl. ..... 70/1.5; 70/416; 70/421

[58] Field of Search ..... 70/1.5, 1.7, 333 R, 70/416, 421

[56] References Cited

U.S. PATENT DOCUMENTS

| | | | |
|---|---|---|---|
| 2,004,434 | 6/1935 | Fitzgerald | 70/1.5 |
| 2,228,971 | 1/1941 | Penkratz | 70/1.5 |
| 4,074,548 | 2/1978 | Milton | 70/1.5 |
| 4,512,165 | 4/1985 | Uyeda | 70/1.5 |
| 4,648,255 | 3/1987 | Gartner | 70/417 |

FOREIGN PATENT DOCUMENTS

| | | | |
|---|---|---|---|
| 1533953 | 6/1968 | France | 70/42 |

*Primary Examiner*—Robert L. Wolfe
*Attorney, Agent, or Firm*—Dykema Gossett

[57] ABSTRACT

The invention relates to a cylinder lock with a cylinder housing (1) and, rotatably mounted therein, a cylinder plug (2) comprising a key passage extending in its axial direction, with a lock bit (5) coupled to the cylinder plug and rotatably mounted in the cylinder housing (1), there being provided in the cylinder housing and in the cylinder plug a plurality of mutually aligned bores which extend into the passage and in which there are, by a spring force in the direction of the passage, plug pins which are of different lengths and housing pins which are preferably of the same length, there being formed between the cylinder housing and the cylinder plug a first separating joint traversed by the housing pins when the key is not inserted into the lock, the ends of the plug pins so co-operating with the locking notches of the key that when the key is inserted the pins are displaced in their axial direction into a position in which the bearing ends of all plug and housing pins are located in the first separating joint and so allow a rotation of the cylinder plug and of the lock bit. The invention envisages disposing in the cylinder housing (1) a displaceable barrier element (9) which locks the lock bit (5) as soon as the cylinder plug (2) is removed from the cylinder housing (1). This ensures that even if the cylinder plug is removed from the cylinder housing by force, which results in a shearing of the plug pins, the lock bit cannot be rotated.

13 Claims, 5 Drawing Sheets

Figure 2:
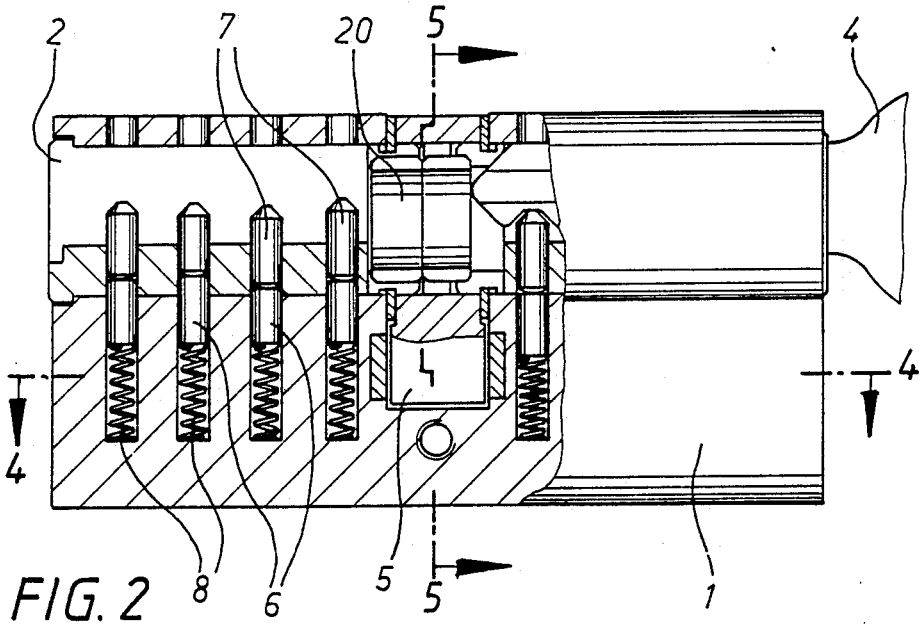

FIG. 1
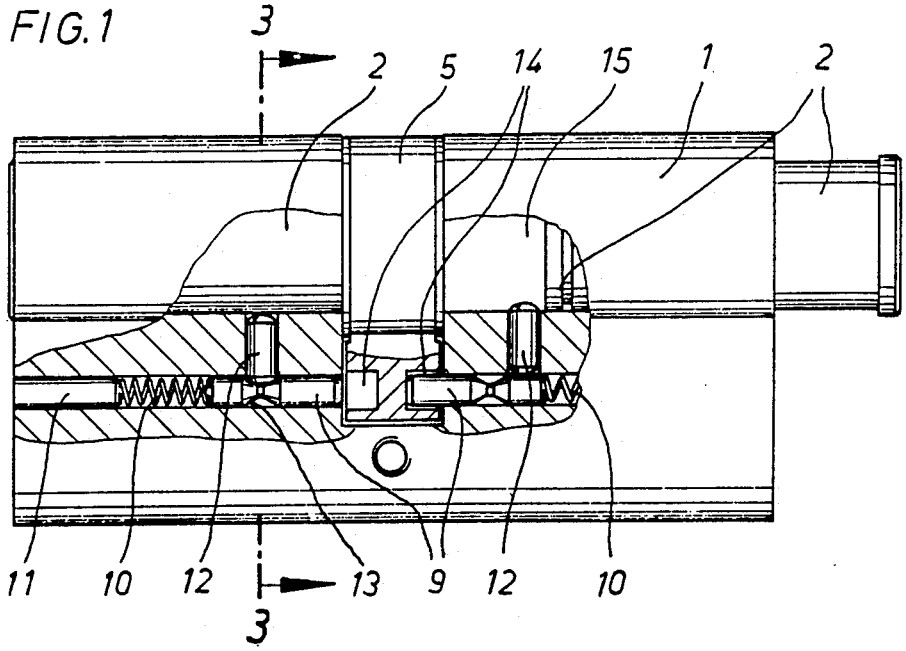
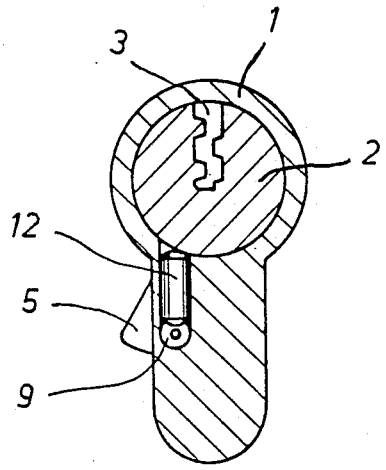
FIG. 3

LOCK BIT ARRESTING CYLINDER LOCK

The invention relates to a cylinder lock with a cylinder housing and, rotatably mounted therein, a cylinder plug comprising a key passage extending in its axial direction, with a lock bit coupled to the cylinder plug and rotatably mounted in the cylinder housing, there being provided in the cylinder housing and in the cylinder plug a plurality of mutually aligned bores extending at right-angles to the cylinder plug axis and into the passage and in which there are, biased by spring force in the direction of the passage, plug pins which are of different lengths, there being formed between the cylinder housing and the cylinder plug a first separating joint traversed by the housing pins when the key is not inserted into the lock, the ends of the plug pins so co-operating with the locking notches of the key that when the key is inserted the pins are displaced in their axial direction into a position in which the bearing ends of all plug and housing pins are located in the first separating joint and so allow a rotation of the cylinder plug and of the lock bit.

Prior art cylinder locks of this type offer only qualified protection against a break-in. Where these locks are concerned, a special tool can, when used with force, extract the cylinder plug from the cylinder housing, the plug pins being sheared off in the separating joint, so that by means of a further tool which can be introduced into the coupling part of the lock bit instead of the cylinder plug, rotation of the lock bit is possible and thus the door can be opened.

The invention is based on the problem of so developing a cylinder lock of the type mentioned at the outset that an increased safeguard against break-in is guaranteed.

According to the invention, the problem posed is resolved in that there is in the cylinder housing a displaceable barrier element which arrests the lock bit as soon as the cylinder plug is removed from the cylinder housing.

Forced withdrawal of the cylinder plug and the resultant shearing of the plug pins thus no longer results in the desired object of being able to actuate the lock bit.

Preferably, the barrier element consists of a locking pin displaceably mounted in a bore which extends in the axial direction of the cylinder housing and which is open towards the lock bit, the locking pin being biased by a spring in the direction of the lock bit, catch means being provided which, when the lock is intact, maintain the locking pin remote from the lock bit and which, when the cylinder plug is extracted, release the locking pin so that it can perform such a displacement that the front end of the locking pin engages a recess in the lock bit or moves into the path of the lock bit.

In a further development of the invention, it is envisaged that the catch means comprise a latching pin displaceably mounted in a bore in the cylinder housing which extends transversely to the locking pin and which ends in the first plane of separation on the one hand and in the bore for the locking pin on the other and in that a taper is provided in the locking pin, the length of the pin being such that one end is flush with the said first separating joint when its other end is engaging the taper in the locking pin.

After withdrawal of the cylinder plug and shearing of the housing pins by an application of force, to prevent the housing being further damaged or misshapen via the locking pin, it is expedient to provide a reinforcing plate of high-strength material in the cylinder housing at the mouth of the locking pin bore.

As a further safeguard, it is advantageous to provide on the lock bit at least one intended breaking point, so that the lock bit breaks off when an attempt is made to rotate it by force.

It is known from the Applicants' own prior application P 38 25 816.6, for coupling of the cylinder plug to the lock bit, to provide a sleeve which is rotatably mounted between cylinder plug and cylinder housing so that in addition to the first separating joint with the cylinder housing, it forms a second separating joint with the cylinder plug. Thus, break-in is made difficult if the plug pins are sheared off by a forced rotation of the cylinder plug, because then it is true that the cylinder plug can be rotated but the sleeve which is coupled to the lock bit remains stationary so that the door can still not be opened.

The invention can also be used in the case of a lock with an additional sleeve in which case, then, there is in the sleeve a bore for passage of the retaining pin when the cylinder plug is withdrawn, the bore being closed when the cylinder plug is inserted, by an incorporated small plate the thickness of which corresponds to the wall thickness of the sleeve.

In this way, there is a double safeguard because rotation of the lock bit is not possible when the cylinder plug is rotated by force nor when the cylinder plug is withdrawn by force.

Expediently, the end of the retaining pin which is towards the cylinder plug is reduced in diameter so that a shoulder is formed, the shoulder having associated with it a step in the bore for the retaining pin to limit its movement in the cavity in the housing which is created when the cylinder plug is removed. This prevents the retaining pin being withdrawn when the plug is missing.

It is advantageous if in the case of a cylinder lock having two lock units which are to be actuated from both sides, the sleeve extends only over the middle portion of the two lock units and co-operates only with some of the plug and housing pins, preferably with only the innermost plug and housing pin of the two units, the bore for the innermost plug and housing pin being constructed in the cylinder plug as a slot which is open towards the inner end of the plug. Thus, the sleeve is on the one hand more difficult of access from outside and on the other, if the plug is removed by force, the innermost housing pin remains in position and locks the sleeve.

The diameter of the innermost plug and housing pins is thereby greater than the diameter of the other plug and cylinder pins, so making it difficult for the innermost housing pin to be sheared off.

Preferably, the innermost housing pins have a portion of reduced diameter with which there is associated an abutment pin which prevents the pin being withdrawn when the cylinder plug is removed.

In a further development of the invention, the locking pin has a front portion having a smaller diameter than the rear portion, the locking pin thus being so disposed in relation to the innermost housing pin that its large diameter portion is in that portion of the housing which is of smaller diameter when the cylinder plug is removed, so locking the housing pin against being depressed.

Bilaterally lockable cylinder locks having two lock units have in their middle portion a coupling which can be displaced in an axial direction by the tip of the key and which, when the key is inserted, ensures that the associated plug engages the lock bit. In this respect, it is advantageous for the sleeve to be sub-divided in the region of the coupling between the two lock units, the sleeve parts having, pointing towards one another, projections which engage recesses on the periphery of the coupling. This has the advantage that the coupling cannot be withdrawn because it is keyed together with the sleeve.

Figure 4:
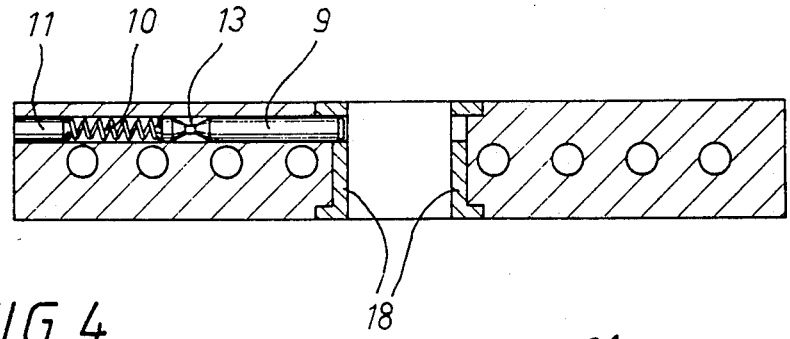
Figure 5:
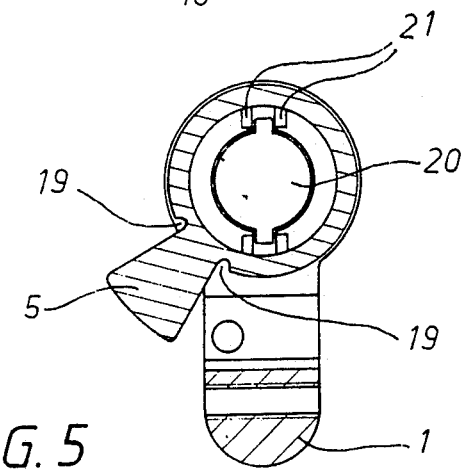
Figure 6:
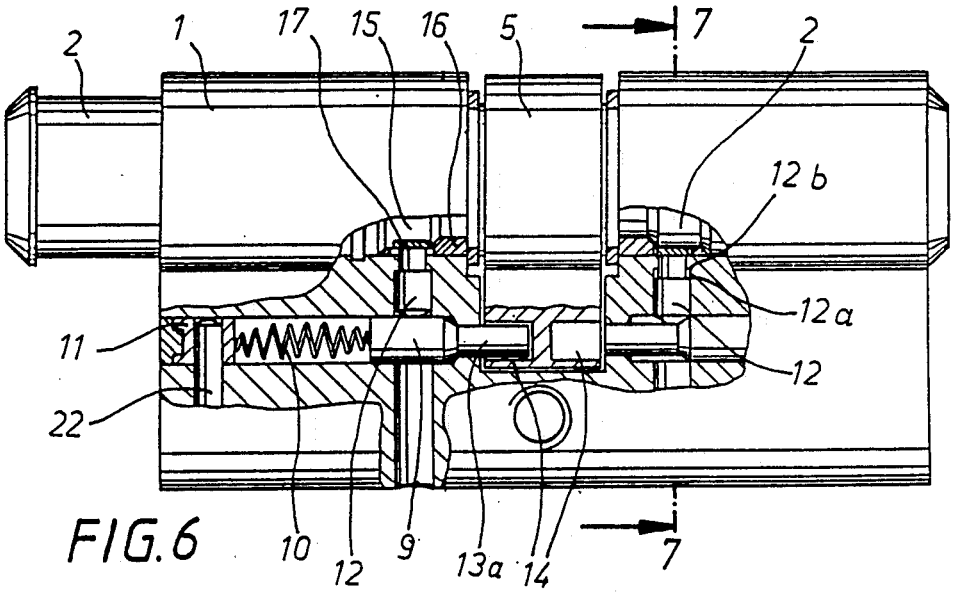
Figure 8:
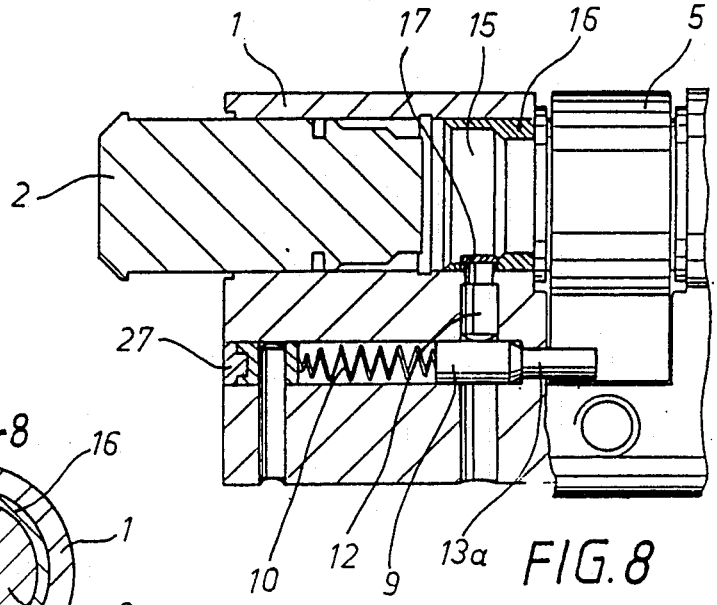
Figure 7:
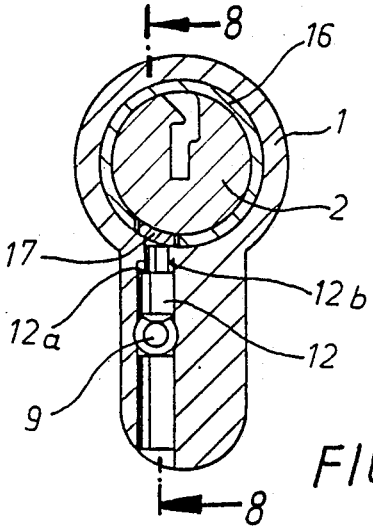
Figure 9:
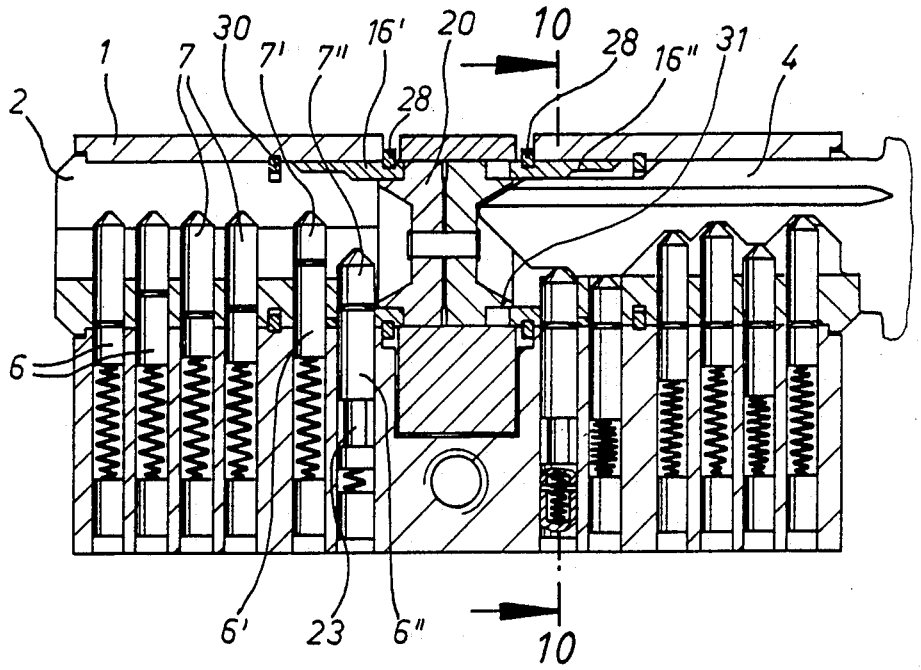
Figure 10:
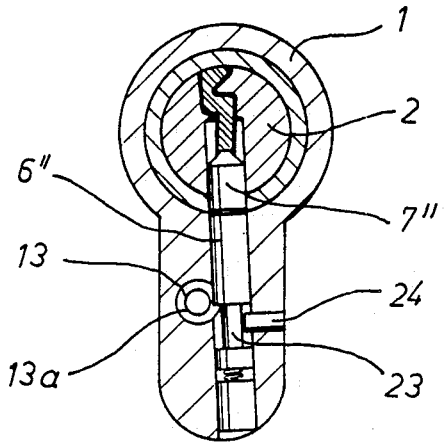
Figure 11:
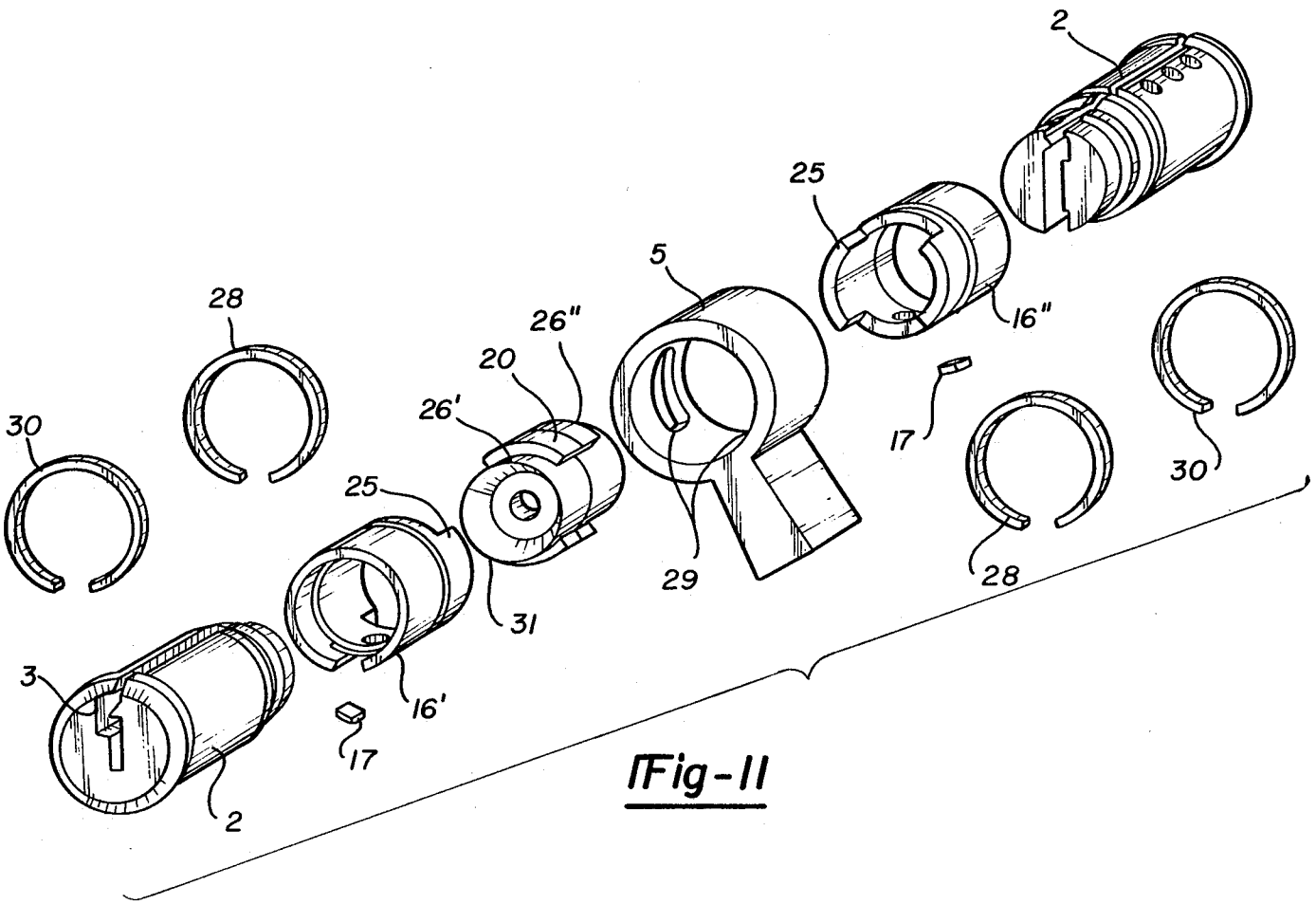

The invention will be explained in greater detail hereinafter with reference to examples of embodiment which are shown in the accompanying drawings, in which:

FIG. 1 is a partially sectional cylinder lock adapted to be closed from both sides, FIG. 2 is a vertical section through the cylinder lock shown in FIG. 1, FIG. 3 is a section taken on the line 3—3 in FIG. 1, FIG. 4 is a section taken on the line 4—4 in FIG. 2, FIG. 5 is a section taken on the line 5—5 in FIG. 2, FIG. 6 is a partially sectional bilaterally lockable cylinder lock with a sleeve surrounding the cylinder plug, FIG. 7 is a section taken on the line 7—7 in FIG. 6, FIG. 8 is a modified form of the embodiment shown in FIG. 6, FIG. 9 is a longitudinal section through a cylinder lock adapted to be operated from both sides, FIG. 10 is a section taken on the line 10—10 in FIG. 9 and FIG. 11 is an exploded view of the interior parts of the cylinder lock according to FIG. 9 without the housing.

In the cylinder housing 1 of the cylinder lock shown in FIGS. 1 to 5 which is adapted to be operated from both sides, there is mounted in conventional manner in each cylinder lock unit a cylinder plug 2 in which there is a passage 3 for the insertion of a key 4. In the cylinder plug 2 and in the cylinder housing 1 of each half of the lock there are four mutually aligned bores which extend at right-angles to the cylinder axis and as far as into the key passage 3 and in which housing pins 6 which are of different lengths and plug pins 7 which are of different lengths are displaceably mounted being biased in the direction of the key passage 3 by springs 8. Formed between the cylinder plug 2 and the cylinder housing 1 is a first separating joint which, when the key is not inserted, is traversed by the housing pins 6 so that the cylinder plug 2 is locked against rotation. Inserting the key displaces the plug and housing pins sufficiently that their bearing ends all come to be in the separating joint so allowing the cylinder plug 2 to be rotated with the lock bit 5.

As has already been mentioned above, in the case of the prior art locks, forced withdrawal of the cylinder plug 2 can cause the plug pins 7 to be sheared off in the separating joint so that a suitable tool can force rotation of the lock bit 5.

The invention then provides for each lock unit to have in the cylinder housing 1 a barrier pin 9 mounted for displacement in a bore extending in the axial direction of the lock, the barrier pin being biased in the direction of the lock bit 5 by a thrust spring 10 which is braced on a bolt 11. The barrier pin 9 is however prevented from performing this movement by a retaining pin 12 mounted for displacement in a bore which extends at right-angles to the barrier pin 9 and which has one end finishing at the separating joint with the cylinder plug 2 while the other end opens out into the bore provided for the barrier pin 9. The barrier pin 9 is provided with a conical narrowed portion 13 into which the retaining pin 12 can engage and the length of the retaining pin 12 is such that it bears on the cylinder plug when the lock unit is intact as shown on the left in FIG. 1.

After each locking operation, the lock bit assumes an attitude in a predetermined angle which is defined by the housing pins 6. Provided in the lock bit 5, and facing the barrier pins 9, there are two recesses 14 which, when the key is not inserted into the lock, and when the lock bit is in the arrested position, are situated in front of the bores for the barrier pins 9.

If, now, the cylinder plug 2 is withdrawn from the cylinder housing 1 by force, as indicated on the right in FIG. 1, the thrust spring 10 is able to push the barrier pin 9 in the direction of the lock bit. Consequently, the retaining pin 12 slides out of the conical narrowed portion 13 of the barrier pin 9 and its end which is towards the cylinder plug 2 can now enter the cavity 15 opened up by the withdrawn cylinder plug. The barrier pin 9 is thus no longer arrested and can move into the recess 14 in the lock bit which is thus secured against rotation.

The example of embodiment shown in FIGS. 1 to 3 is based on the premise that the lock bit, in the starting position, has pivoted sufficiently into the cylinder housing 1 that the barrier pin 9 can drop into the recesses 14. However, it is also conceivable that in the starting position the lock bit is pivoted farther out, as is shown in FIG. 5, and in this case, the barrier pin 9 cannot drop into recesses in the lock bit 5. Then the narrowed portion 13 in the barrier pin 9 is so disposed and its length is so dimensioned that upon withdrawal of the cylinder plug, the barrier pin 9 can be pushed forwards out of the position shown on the left in FIG. 4 and as far as the right hand lock unit so that it lies in the path of the lock bit 5 which can no longer be moved past the barrier pin 9. This however, presupposes that the lock is fitted in the door in the right position, which can be identified on the outside of the lock.

FIG. 4 furthermore shows that a reinforcing plate 18 of high-strength material is provided at the mouth of the bore for the barrier pin 9 in respect of the lock bit 5, on each of the two lock units, to prevent an application of force to the barrier pin 9 damaging or misshaping the housing after a forced withdrawal of the cylinder plug. Preferably, the reinforcing plates 18 consist of hard metal.

As a further safeguard, one or two intended breaking points 19 may be provided on the lock bit, as shown in FIG. 5, at which the lock bit 5 can break off when an attempt is made to turn it by force after the cylinder plug has been removed. In addition, it is also possible to provide a further weakened point in that only weak dogs 21 are provided for the coupling 20 to the lock bit, the dogs being just sufficiently strong to accommodate the forces when the lock is operated but which snap off when force is applied.

In the case of the example of embodiment shown in FIGS. 6, 7 and 9 to 11, there is provided between the cylinder plug 2 and the cylinder housing 1 a sleeve 16 which is connected via the coupling 20 to the lock bit 5 when a key 4 is pushed into the key passage 3 in one of the two lock units. In this embodiment, the function is the same as with that shown in FIGS. 1 to 3 but provided in each of the sleeves of the two lock units is a bore to allow the passage of the retaining pin 12 which, when the cylinder plug 2 is fitted, is closed by an inserted plate 17 the thickness of which corresponds to the wall thickness of the sleeve 16. If, as shown in FIG. 6 in the case of the right hand lock unit, the cylinder plug 2 is withdrawn by force, the retaining pin 12 moves through the sleeve 16 into the now empty cavity 15, the plate 17 also being pushed into this cavity so that the retaining pin 12 prevents the sleeve 16 from rotating. Therefore, with this embodiment, neither forced rotation of the cylinder plug 2 nor forced extraction can achieve the aim of being able to open the door.

It is evident that the barrier pin 9 and the retaining pin 12 are disposed sufficiently laterally in the cylinder housing 1 that the function of the housing pins 6 and of the plug pins 7 is not adversely affected. If necessary, the housing and plug pins can however also be obliquely disposed in the cylinder housing 1 in order to achieve an optimum spatial configuration.

That end of the retaining pin 12 which is towards the cylinder plug 2 is of reduced diameter, so that a shoulder **12*a* is formed, there being associated with the shoulder 12*a* a step 12*b* in the bore for the retaining pin, so that the movement of the retaining pin is limited upon removal of the cylinder plug so preventing the retaining pin being pulled out by means of a tool. With this embodiment, the tapered part of the barrier pin 9 is formed by a front portion 13*a* which is of smaller diameter than the rear portion, there being at the transition between the two a cone over which the retaining pin 12** can easily slide.

With this embodiment, too, the spring 10 is braced on a bolt 11 in the bore for the barrier pin 9, a pin 22 extending at right-angles to the longitudinal axis of the barrier pin 9 engaging the bolt 11 so preventing the bolt 11 being extracted from the outside. The pin 22 ought to consist of hard metal so that it additionally increases the resistance to the lock being drilled out. A closure cap 27 of phosphorescent material can on the outside indicate that the lock is one which offers a particularly high level of security.

As FIG. 9 shows, the sleeve 16 extends over only the middle portion of the two lock units, each lock unit having in this middle portion two additional housing pins 6' and 6'' and associated plug pins 7' and 7''. The bore for the innermost plug and housing pin 6'' or 7'' being constructed in the cylinder plug 2 as a slot open towards the inner end of the plug so that upon forced withdrawal of the plug, these pins remain undamaged and still prevent the sleeve 16 from being rotated. To avoid a forced shearing of the innermost housing pin 6'', the diameter of the pins 6'' and 7'' is greater than the diameter of the other plug and cylinder pins. Furthermore, the bore for the housing pin 6'' is constructed in the sleeve 16 as an outwardly open slot so that upon forced withdrawal of the plug 2 the sleeve 16 is not damaged by the housing pin 6'.

The innermost housing pins 6'' comprise a portion 23 of reduced diameter with which an abutment pin 24 is associated which limits the upwards movement of the housing pin 6'' when the cylinder plug is removed by force, and which also makes it impossible to extract the housing pin 6''.

The portion 23 of smaller diameter furthermore cooperates with the barrier pin 9. When, as shown in FIG. 6, the barrier pin 9 has engaged the lock bit 5, because the plug 2 has been removed by a force, its larger diameter portion moves into the region 23 of the housing pin 6'' so preventing the housing pin 6'' being forced downwards and so releasing the sleeve 16.

In the sectional view in FIG. 9, the two parts 16' and 16'' of the sleeve 16 and the coupling 20 which is displaceable between the two parts in the axial direction of the cylinder plugs 2 can be seen. Locking rings 28 which, when the lock is fitted, are not accessible, secure the sleeve parts rotatably in the housing 1. Locking rings 30 fix the plug 2 in the housing 1 in the area outside the sleeve 16 and counteract any withdrawal of the plug 2.

The exploded view in FIG. 11 shows that oppositely disposed projections 25 are provided on the sleeve parts 16' and 16'' and engage recesses 29 on the periphery of the coupling 20. In the interior of the lock bit 5 which accommodates the coupling 20 there are likewise projections which engage the recesses 29. In this way, the sleeve parts are keyed to the coupling and to the lock bit.

At its outwardly pointing ends, the coupling is provided with conically tapering projections 31 which always engage over the two sleeve parts 16' and 16'', in other words even when the coupling 20 is displaced axially by an inserted key, so that when the cylinder plug is withdrawn, it is impossible to grip and thus withdraw the sleeve and coupling by force even with a special tool.

When no key is in the lock, the projections 29 are substantially centrally disposed in the recesses 27 in the coupling and the projections 25 plunge somewhat into the recesses 26. If, then, a key is introduced into the key passage 3 in the left hand plug 2, the coupling 20 is displaced rightwardly, so that the right hand half 26'' of the coupling which is rotatable in respect of the left hand half 26' is pushed out of the region of the projections 29 of the lock bit so that the right hand lock unit is uncoupled and the plug 2 of the left hand lock unit is coupled to the lock bit via the sleeve part 16', the projections 25 engaging the recesses 26 and the projections 29 which likewise engage the recesses 26, so that the lock bit can be rotated in order to open the lock.

FIG. 8 shows a similar view to that in FIG. 6, the only difference being that the front portion **13*a* of the barrier pin 9 does not engage the lock bit 5** but moves into the pivoting path thereof, so forming a barrier.

I claim:

1. A cylinder lock with a cylinder housing and, rotatably mounted therein, a cylinder plug comprising a key passage extending in its axial direction, with a lock bit coupled to the cylinder plug and rotatably mounted in the cylinder housing, there being provided in the cylinder housing and in the cylinder plug a plurality of mutually aligned bores extending at right-angles to the cylinder plug axis and into the passage and in which housing pins which are preferably of equal length and plug pins which are of different lengths are biased in the direction of the passage by spring force, there being formed between the cylinder housing and the cylinder plug a first separating joint traversed by the housing pins when the key is not inserted into the lock, the ends of the plug pins so co-operating with the locking notches of the key that when the key is inserted the pins are displaced in their axial direction into a position in which the bearing ends of all plug and housing pins are located in the first separating joint and so allow a rotation of the cylinder plug and of the lock bit, characterised in that there is in the cylinder housing (1) a displaceable barrier element (9) which locks the lock bit (5) within the cylinder housing 1 when the cylinder plug (2) is removed from the cylinder housing (1).

2. A cylinder lock according to claim 1, characterised in that the barrier element consists of a barrier pin (9) which is displaceably mounted in a bore extending in the axial direction of the cylinder housing (1) and open towards the lock bit (5) and in that the barrier pin (9) is biased in the direction of the lock bit (5) by a spring (10) and in that catch means (12, 13) are provided which, when the lock is intact, maintain the barrier pin (9) remote from the lock bit and which, when the cylinder plug is removed, release the barrier pin (9) to perform such a displacement that the front end of the barrier pin engages a recess (14) in the lock bit (5) or moves into the path of the lock bit.

3. A cylinder lock according to claim 2, characterised in that the catch means comprise a retaining pin (12) mounted for displacement in a bore in the cylinder housing (1) extending transversely to the barrier pin (9) and which ends in the first separating plane at one end and in the bore for the barrier pin (9) at the other, and in that there is in the barrier pin a tapered portion (13) and in that the length of the retaining pin (12) is so dimensioned that its end is flush with the aforesaid first separating joint when its other end is engaging the tapered portion (13) of the barrier pin (9).

4. A cylinder lock according to claim 1 characterised in that a reinforcing plate (18) of highstrength material is provided in the cylinder housing (1) at the mouth of the bore for the barrier pin (9) in respect of the lock bit (5).

5. A cylinder lock according to claim 1 characterised in that at least one intended breaking point (19) is provided on the lock bit (5).

6. A cylinder lock according to claim 1 characterised in that for coupling the cylinder plug (2) to the lock bit (5), a sleeve (16) is provided which is rotatably mounted between cylinder plug (2) and cylinder housing (1) so that in addition to the first separating joint with the cylinder housing, a second separating joint with the cylinder plug is formed and in that there is in the sleeve (16) a bore to allow passage of the retaining pin (12) when the cylinder plug (2) is withdrawn and which, when the cylinder plug (2) is fitted, is closed by an inserted plate (17), the thickness of which corresponds to the wall thickness of the sleeve (16).

7. A cylinder lock according to claim 6, characterised in that the end of the retaining pin (12) which is towards the cylinder plug (2) is of reduced diameter, forming a shoulder (12*a*), the shoulder (12*a*) having associated with it in the bore for the retaining pin (12) a step (12*b*) for limiting its movement in the cavity (15) created in the housing (1) when the cylinder plug (2) is removed.

8. A cylinder lock having two lock units adapted to be operated from both sides, according to claim 7, characterised in that the sleeve (16) only extends over the middle portion of the two lock units and co-operates with only some plug and housing pins, preferably only the innermost plug and housing pin (6″, 7″) of the two units, and in that the bore for the innermost plug and housing pin is constructed in the cylinder plug as a slot which is open towards the inner end of the plug.

9. A cylinder lock according to claim 8, characterised in that the diameter of the innermost plug and housing pins (6″, 7″) is larger than the diameter of the other plug and housing pins.

10. A cylinder lock according to claim 9, characterised in that the innermost housing pins (6″) have a portion (23) of reduced diameter with which is associated an abutment pin (24) which prevents the pin being withdrawn when the cylinder plug (2) is removed.

11. A cylinder lock according to claim 10, characterised in that the tapering of the barrier pin (9) consists of a front portion (13*a*) which has a smaller diameter than its rear portion, and in that the barrier pin (9) is so disposed in relation to the innermost housing pin (6″) that its large diameter portion moves into the portion (23) of the housing pin (6″) of smaller diameter when the cylinder plug (2) is removed, so preventing the housing pin (6″) from being pushed downwards.

12. A cylinder lock according to claim 11, characterised in that in the region of the coupling (20) disposed between the two lock units and which, when the key is inserted, produces the connection to the lock bit (5) by axial displacement, is sub-divided and in that the sleeve parts comprise projections (25) which point at one another and which engage in recesses (26) on the periphery of the coupling (20).

13. A cylinder lock according to claim 12, characterised in that at its outwardly pointing ends, the coupling (20) is provided with conically tapering projections (31) which constantly engage over the two sleeve parts (16′, 16″), regardless of their axial position.

* * * * *